US011640770B2

(12) United States Patent
Sisko

(10) Patent No.: US 11,640,770 B2
(45) Date of Patent: May 2, 2023

(54) CURVED INSERT FOR SIGN BOARD AND SIGN BOARD SYSTEM

(71) Applicant: K-International, Inc., Waukegan, IL (US)

(72) Inventor: Michael L. Sisko, Kenosha, WI (US)

(73) Assignee: K-International, Inc., Waukegan, IL (US)

( * ) Notice: Subject to any disclaimer, the term of this patent is extended or adjusted under 35 U.S.C. 154(b) by 0 days.

(21) Appl. No.: 17/679,231

(22) Filed: Feb. 24, 2022

(65) Prior Publication Data

US 2022/0270521 A1 Aug. 25, 2022

Related U.S. Application Data

(60) Provisional application No. 63/153,119, filed on Feb. 24, 2021.

(51) Int. Cl.
*G09F 7/14* (2006.01)
*G09F 7/10* (2006.01)

(52) U.S. Cl.
CPC . *G09F 7/14* (2013.01); *G09F 7/10* (2013.01)

(58) Field of Classification Search
CPC ..... G09F 7/14; G09F 7/10
See application file for complete search history.

(56) References Cited

U.S. PATENT DOCUMENTS 2,608,777 A * 9/1952 Schuler ..... G09F 3/20 211/45
2,669,964 A * 2/1954 Wexler ..... G09F 7/10 40/649
2,838,860 A * 6/1958 Finnerty ..... G09F 7/10 40/650
3,154,870 A 11/1964 Hopp
3,174,239 A * 3/1965 Cramer ..... G09F 7/10 40/650
3,778,915 A 12/1973 Freeman et al.
3,984,931 A * 10/1976 Belokin, Jr. ..... G09F 7/08 40/559
4,262,436 A 4/1981 Clement
4,357,773 A 11/1982 Dennis
4,406,075 A * 9/1983 Jaffe ..... G09F 7/10 40/651
4,434,570 A 3/1984 Roos
4,461,107 A * 7/1984 Grate ..... G09F 7/10 434/430

(Continued)

FOREIGN PATENT DOCUMENTS

FR 2936896 A1 4/2010
GB 2128011 A 4/1984

OTHER PUBLICATIONS

Hooked on Magnets, Website by Freedom's Design LLC, Copyright 2014, 2 pages.

*Primary Examiner* — Gary C Hoge
(74) *Attorney, Agent, or Firm* — Banner & Witcoff Ltd.

(57) ABSTRACT

A channel insert may be inserted into and secured within a sign board. The channel insert may include a concave surface and a convex surface opposite the concave surface. When the channel insert is inserted into a panel of the sign board, the concave surface may engage an inner surface of a channel track of the panel, and the convex surface may engage a surface of the panel to secure the channel insert in the sign board.

21 Claims, 14 Drawing Sheets

(56) References Cited

U.S. PATENT DOCUMENTS 4,521,984 A * 6/1985 Murray ..... G09F 7/10 40/490
4,593,486 A 6/1986 Visocky et al.
4,641,448 A 2/1987 Cobb et al.
4,698,928 A 10/1987 Soporowski
4,817,316 A * 4/1989 Walker ..... G09F 13/04 40/576
4,884,351 A 12/1989 Abramson
4,991,334 A 2/1991 Amundsen
5,065,537 A 11/1991 Bailey
5,088,221 A * 2/1992 Bussiere ..... G09F 13/04 40/576
5,090,145 A 2/1992 Chiang et al.
5,188,332 A 2/1993 Callas
5,257,472 A * 11/1993 Harnois ..... G09F 7/10 40/607.14
5,381,991 A 1/1995 Stocker
5,409,191 A 4/1995 Wenmaekers
5,456,034 A 10/1995 Lewis et al.
5,511,332 A * 4/1996 Sturkie ..... G09F 15/0068 248/223.41
5,588,238 A 12/1996 Visocky et al.
5,806,823 A 9/1998 Callas
5,870,845 A 2/1999 Ruderman et al.
5,930,926 A 8/1999 Kaplan
6,048,010 A 4/2000 Stocker
6,092,320 A 7/2000 Bringuet
6,334,602 B1 1/2002 Clarke
6,435,464 B1 8/2002 Sullivan et al.
6,671,988 B2 1/2004 Cyrluk
7,373,748 B2 5/2008 Pitcher et al.
7,823,311 B2 11/2010 Pitcher et al.
9,898,941 B2 2/2018 White
2004/0098895 A1 5/2004 Sparkowski
2005/0262745 A1 * 12/2005 Polvere ..... G09F 7/10 40/611.12
2006/0117630 A1 6/2006 Raia et al.

* cited by examiner

Great Bun!
A 1 2 3
B 4 5 6
2
4
6
7
8
9
10
12
13
14
15
19
20

CURVED INSERT FOR SIGN BOARD AND SIGN BOARD SYSTEM

CROSS REFERENCE TO RELATED APPLICATIONS

This patent application claims priority to, and the benefit of, U.S. Provisional Patent Application No. 63/153,119, filed Feb. 24, 2021, and titled "CURVED INSERT FOR SIGN BOARD." This application is incorporated herein by reference in its entirety.

BACKGROUND

Field

The present disclosure relates generally to a channel insert for a sign board adapted for interchangeable signs held in tracks or channels of the sign board.

Related Art

Convenience stores, gas stations, markets, grocery stores, other types of stores and shops, warehouses, and other facilities may use signs that have interchangeable sign elements. One type of sign has a sign board on which are formed channels or tracks into which sign elements are inserted. A common sign element is a strip of cardboard, plastic or other material which has been printed with the desired text or image. The strip sign element is mounted on the sign board by sliding the strip sign element into the track or channel. Sign boards are provided that accept one, two, three, or more of the strip sign elements. The sign boards may have tracks or channels on one or both sides so that the strip sign elements may be displayed on just one side or on both sides of the sign board. Sign boards that use strip sign elements mounted in channel tracks may be used to display product information, navigational information (e.g. aisle and/or shelf indicator), or other information.

With conventional sign boards, inserted signage may move within its respective track or channel, including partially or completely sliding out of the track or channel. Such boards may use additional fasteners or adhesive to secure the sign with track or channel. However, these conventional solutions require additional components and/or may render the sign permanently fastened in the channel or track.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figures 1, 2:
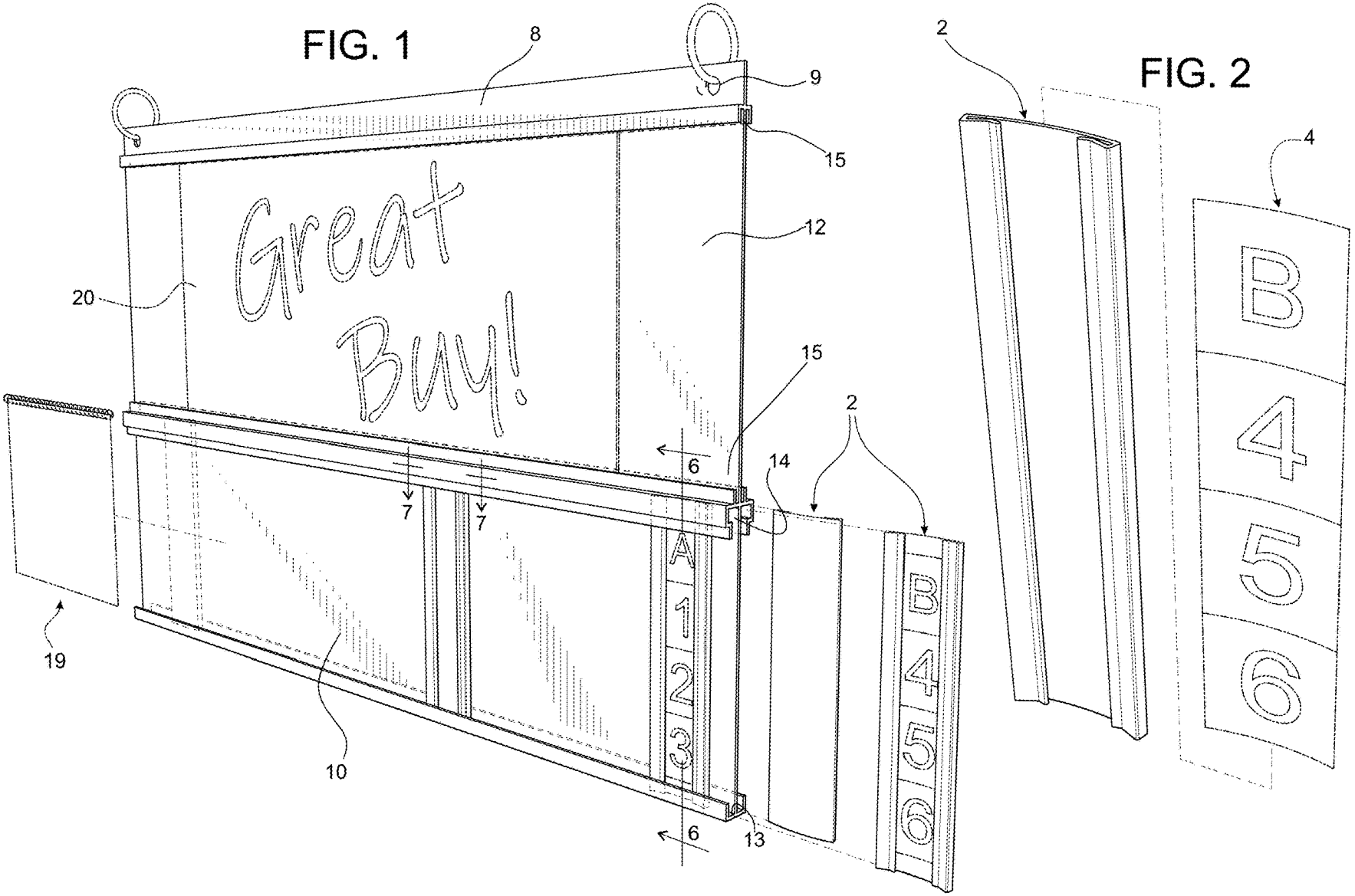
FIG. 1 is a perspective view of a sign board with a channel insert according to an exemplary embodiment of the present disclosure.
FIG. 2 is a perspective view showing the channel insert according to an exemplary embodiment of the present disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art.

The present disclosure provides a channel insert 2 for a sign board 8. The channel insert 2 is configured to accommodate one or more pieces of signage 4. The channel insert 2 may then be inserted into the sign board 8 as illustrated in the drawings and described in more detail below.

As illustrated in FIG. 1, the sign board 8 may include one or more panels 10, 12. The panels 10, 12 are configured to hold and display signage of various forms. For example, signage in the form of a display strip 20 may be inserted and held in panels 10 and/or 12. Panel 10 may be configured to accommodate one or more display strips 20, with the ability to additionally or alternatively accommodating thicker signage, such as a spiral bound pad 19 that may include pre-printed information. The spiral bound pad 19 may include several pages bound by a spiral binding. When removed from the sign panel 10, the pages of the spiral bound pad may be flipped to reveal the desired information.

Once the desired information is on the front page, the spiral bound pad 19 may be inserted into panel 10.

The sign board 8 may be hung from a ceiling or other structure via holes 9, which are configured to accept one or more fasteners (e.g. hooks, screws, etc.). FIG. 1 illustrates rings shown in broken line as an example fastener or other means to suspend the sign board 8, but the disclosure is not limited thereto. For example, the signboard may be mounted to a surface using a nail, screw, or other type of fastener that engages the holes 9.

In an exemplary embodiment, the panel 10 includes a lower channel track 13 and upper channel track 14 that together define the panel 10. The lower channel track 13 and upper channel track 14 are configured to accept the thicker spiral bound pad 19, which is generally thicker than a display strip 20. In this example, the panel 12 includes lower and upper channel tracks 15 that have a depth that is less than the depth of the channel tracks 13 and 14 of panel 10. Although the channel tracks 15 of panel 12 are dimensionally the same, the top and bottom channel tracks 15 may be differently dimensioned in other embodiments. Further, the sign board 8 may include two or more panels that are configured to accommodate similarly sized signage and accordingly have similar dimensioned channel tracks as would be understood by one of ordinary skill in the art. The different depths and dimensions of the respective channel tracks are further illustrated in cross section in FIG. 6. The number of panels of the sign board 8 are not limited, and the sign board can include fewer or additional panels as would be understood by one of ordinary skill in the art. Additional and/or alternatively, one or more sign boards 8 may be connected together using one or more fasteners, as would be understood by one of ordinary skill in the art. For example, U.S. Pat. No. 9,898,941, which is incorporated herein by reference in its entirety, describes a modular sign board system that includes modular panels that are configured to be combined to form a sign board with a customized number and/or type of panels forming the sign board.

As shown in the drawings, the panels 10, 12 of the sign board 8 are double sided. In a dual sided configuration, the sign board 8 includes panels 10 and/or panels 12 on both the front 16 and rear 17 sides of the sign board 8. In other embodiments, the panel 10 and/or panel 12 may be single sided.

In an exemplary embodiment, the panel 10 having the channel tracks 13 and 14 is configured to accommodate the channel insert 2. In this configuration, the channel insert 2 has a thickness generally larger than the display strips 20 similar to the spiral bound pad 19. The channel insert 2 may be configured with different dimensions, as would be understood by one of ordinary skill in the art, to allow the channel insert 2 to be used with differently dimension channel tracks, including those of panel 12.

Figure 6:
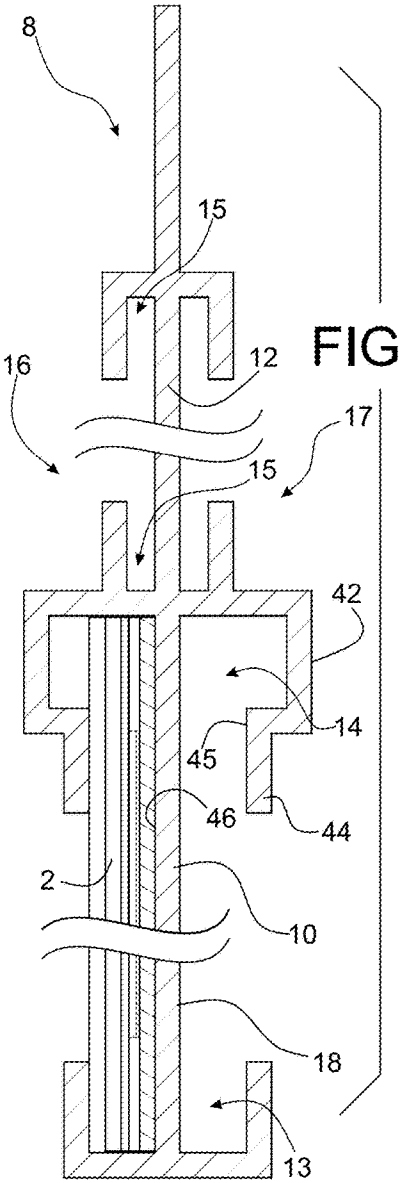
FIG. 6 is a cross-sectional view, partially broken away, of the sign board with a channel insert of FIG. 1 taken along line 6-6.
Figure 8:
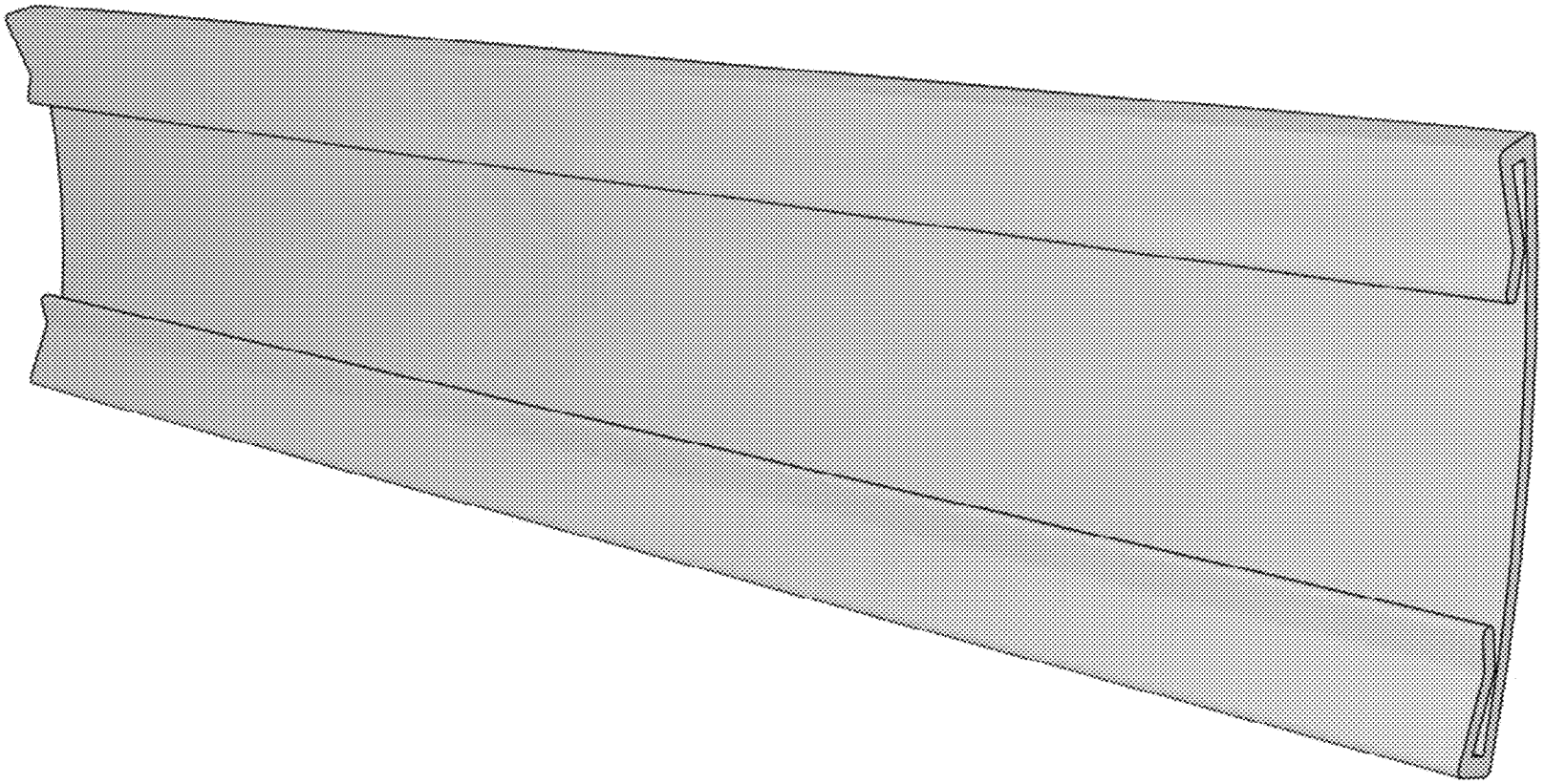
FIGS. 8-17 are additional perspective views showing the channel insert according to exemplary embodiments of the present disclosure.
Figure 10:
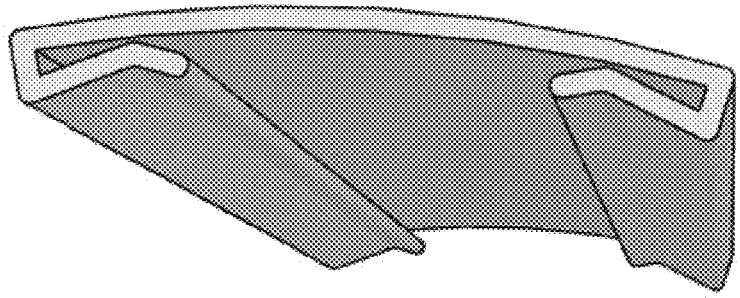
Figure 9:
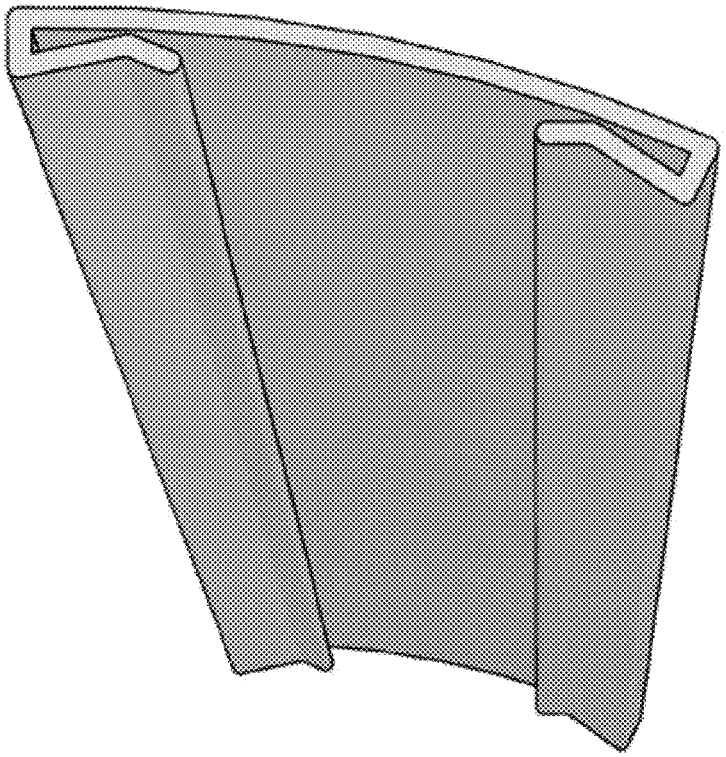
Figure 12:
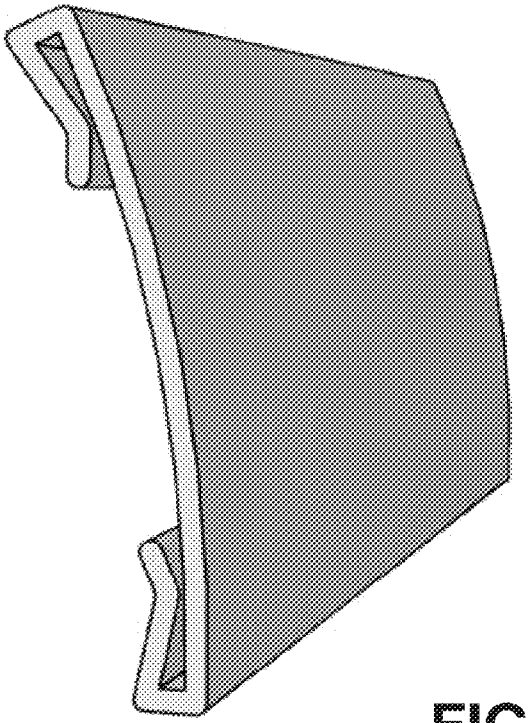
Figure 11:
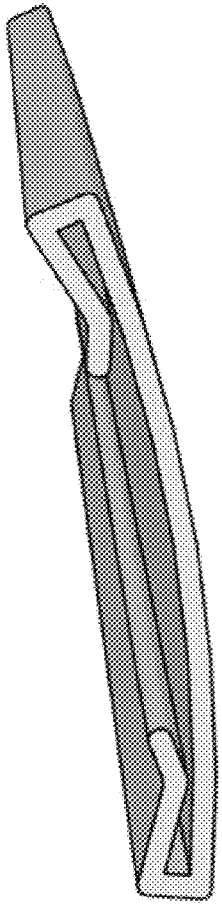
Figure 13:
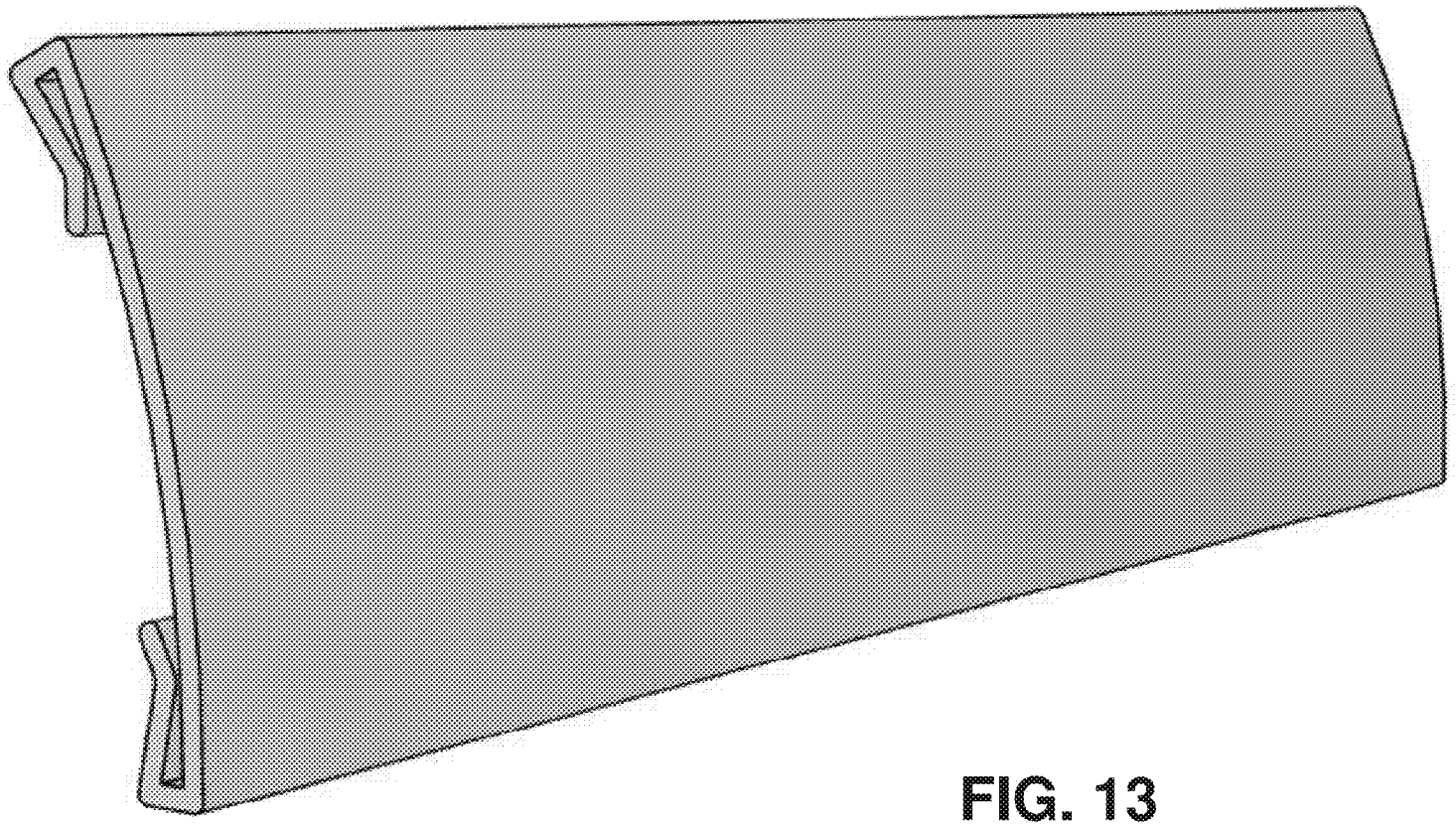
Figure 14:
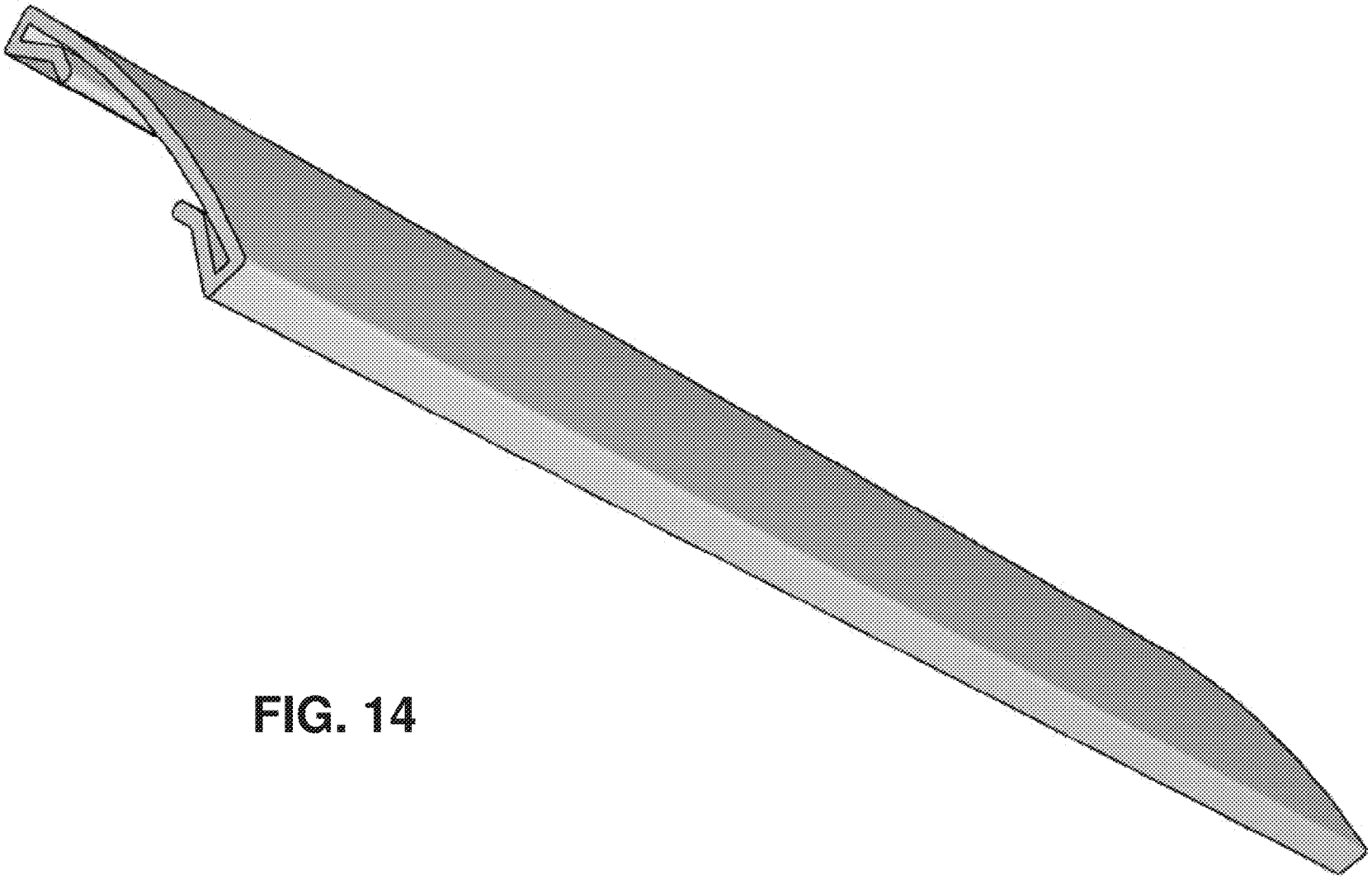
Figure 15:
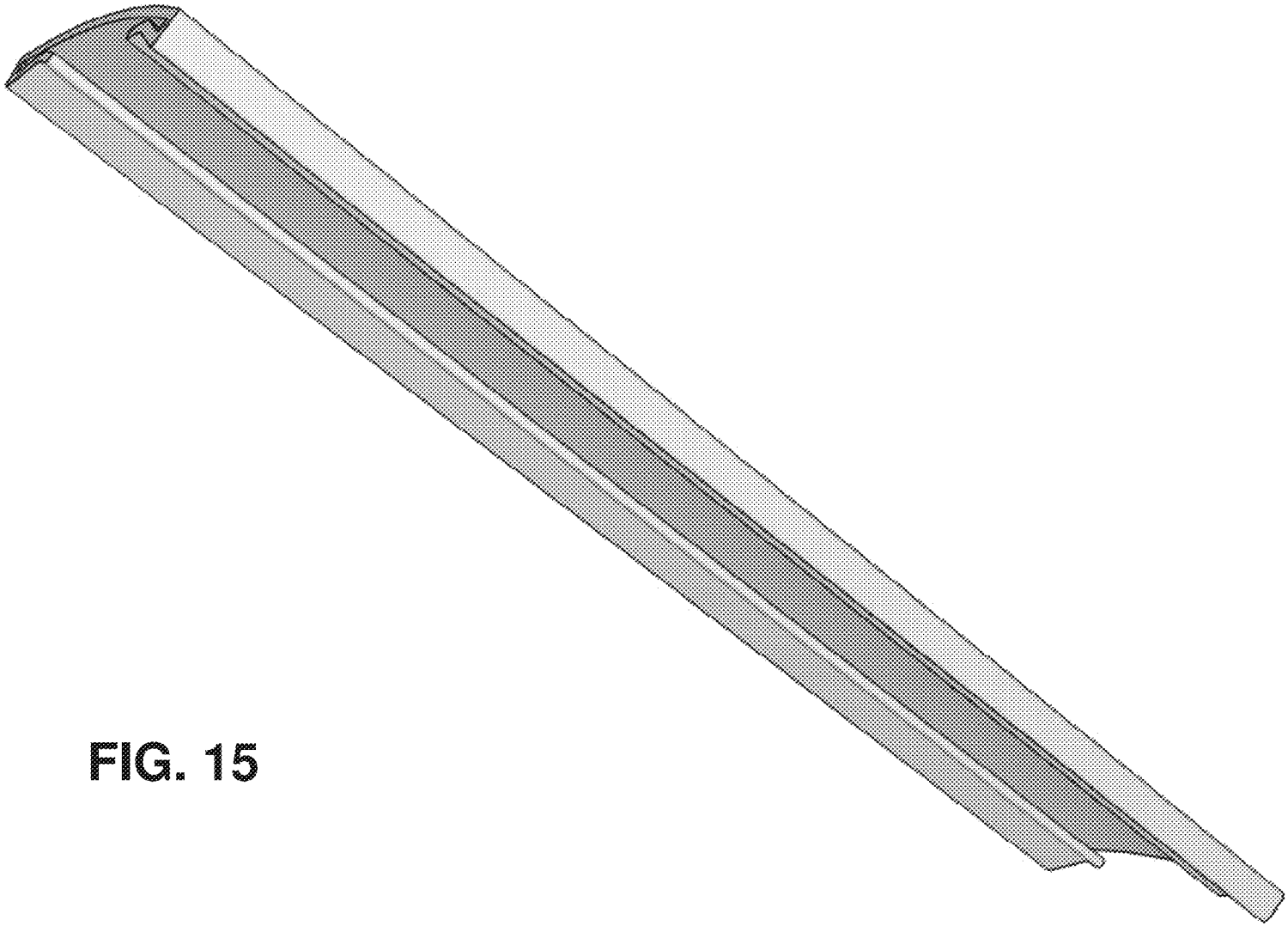
Figure 16:
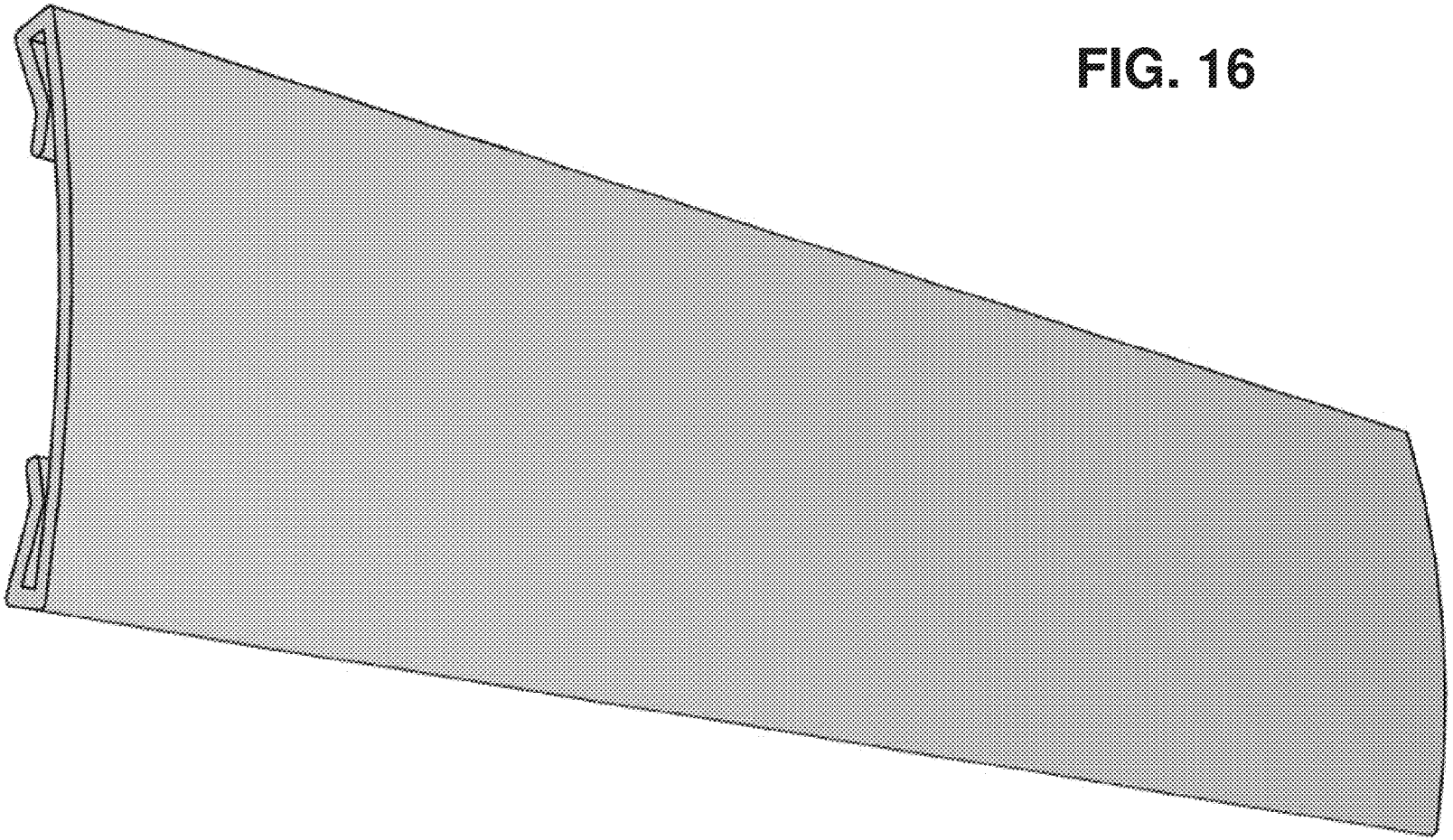
Figure 17:
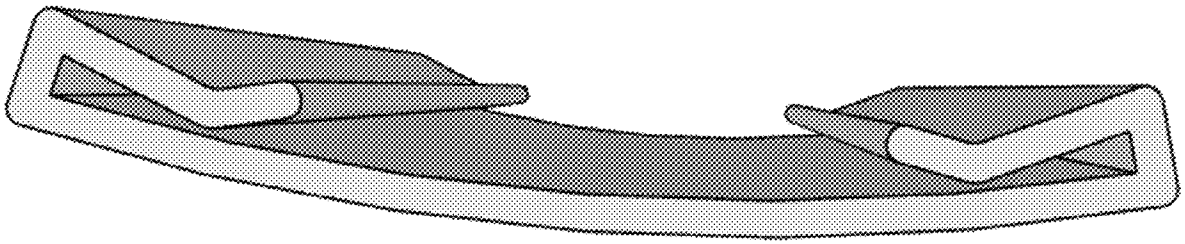
Figure 19:
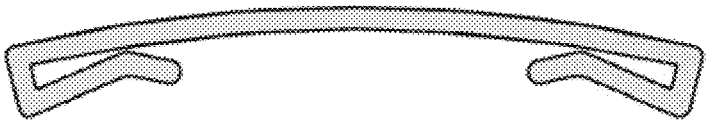
FIG. 19 is a bottom view showing the channel insert according to an exemplary embodiment of the present disclosure.
Figure 18:
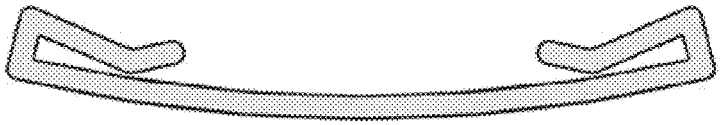
FIG. 18 is a top plan view showing the channel insert according to an exemplary embodiment of the present disclosure.
Figure 20:
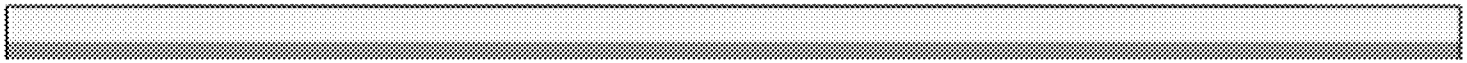
FIG. 20 is a left-side elevational view showing the channel insert according to an exemplary embodiment of the present disclosure.
Figure 21:
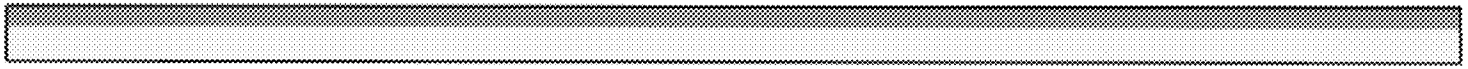
FIG. 21 is a right-side elevational view showing the channel insert according to an exemplary embodiment of the present disclosure.
Figure 22:
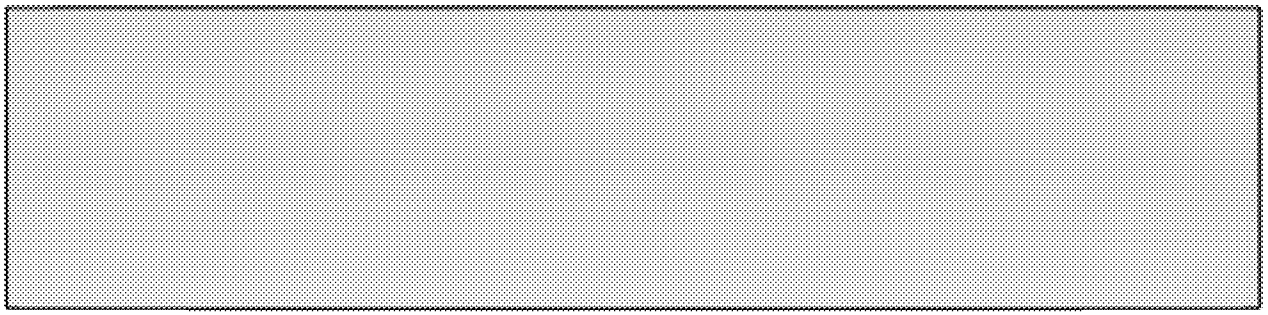
FIG. 22 is a back elevational view showing the channel insert according to an exemplary embodiment of the present disclosure.
Figure 23:
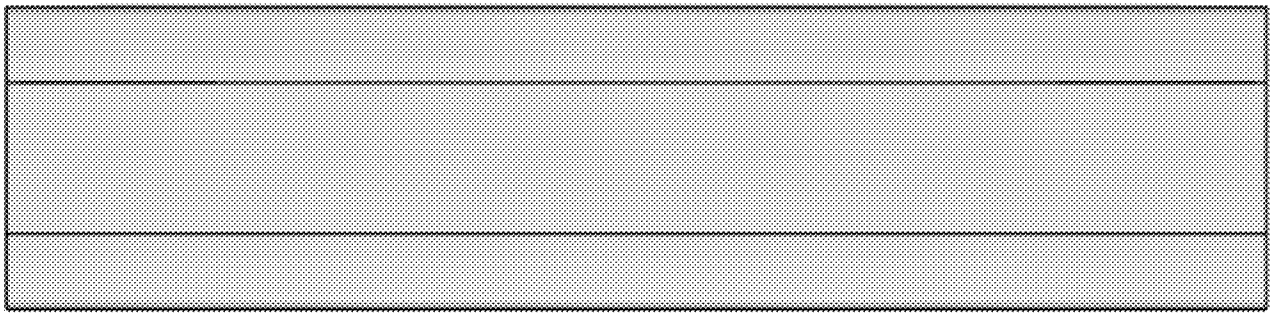
FIG. 23 is a front elevational view showing the channel insert according to an exemplary embodiment of the present disclosure.

As shown in FIGS. 1 and 6, the top channel track 14 may be of sufficient size to accept the spiral binding of the spiral bound pad 19. The top channel track 14 may include an outwardly directed portion 42 and inwardly directed portion 44. The outwardly directed portion 42 is configured to accommodate the spiral binding of the spiral bound pad 19 and the inwardly directed portion 44 is configured to engage beneath the spiral binding to help prevent the spiral binding from coming out of the channel track 14 except at the end. The lower channel track 13 extends far enough from the panel 10 to accept the pages of the spiral bound pad 19, and in some embodiments, also a display strip. The inwardly directed portion 44 has an inner surface 45 that extends a same distance as the inner surface of the bottom channel track 13. In other embodiments, this distance may be different. In some embodiments, the top channel track 14 is configured without the outwardly directed portion 42 so as to be similar to the lower channel track 13.

The channel insert 2 may be removably inserted into the channel tracks 13, 14 of the panel 10 of the sign board 8. For Example, the channel insert 2 may be inserted into an end of the panel 10 at the opening of the channel tracks 13, 14 at the side of the sign board 8 as illustrated by the dashed lines in FIG. 1.

Once inserted, the channel insert 2 may be slid along the panel 10 within the channel tracks 13, 14 to position the channel insert 2 at a desired position within the panel 10. One or more additional channel inserts 2 may be inserted into the panel 10 so that the panel holds multiple channel inserts 2 as is illustrated in FIG. 1. The channel insert(s) 2 may be used in combination with one or more other types of signage, such as the spiral bound pad 19, display strips 20, or the like.

Figure 5:
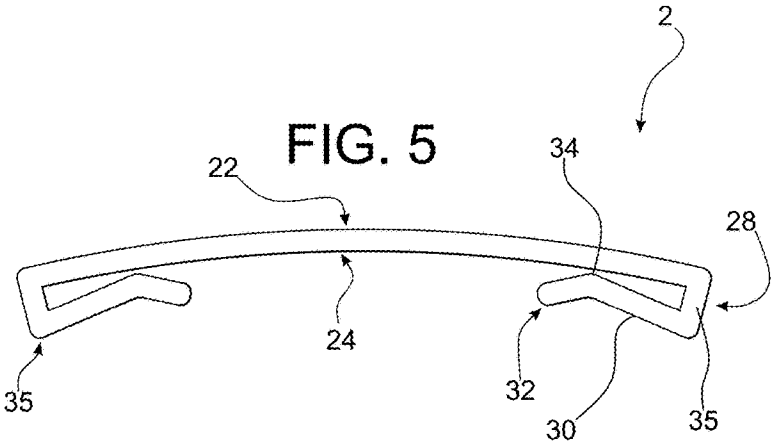
FIG. 5 is a top plan view showing the channel insert according to an exemplary embodiment of the present disclosure.
Figure 4:
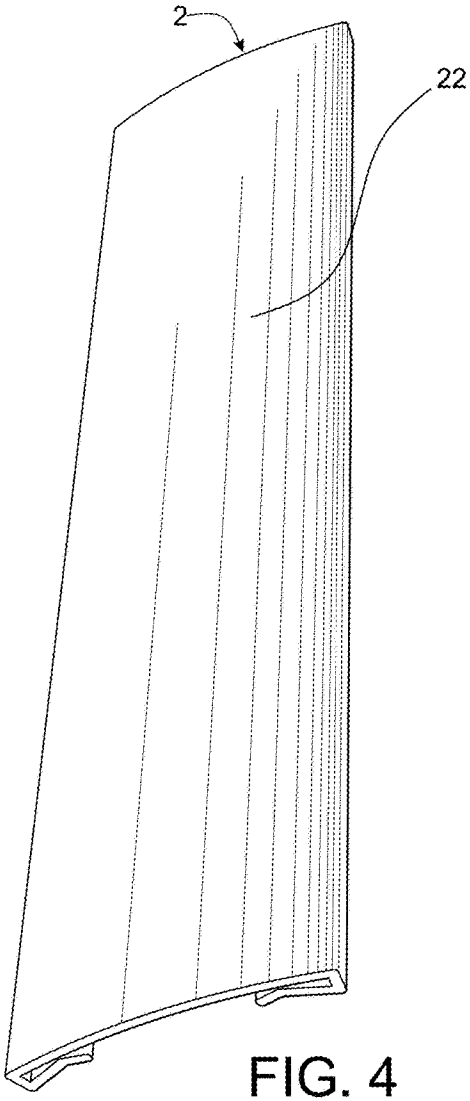
FIG. 4 is a back, bottom perspective view showing the channel insert according to an exemplary embodiment of the present disclosure.
Figure 3:
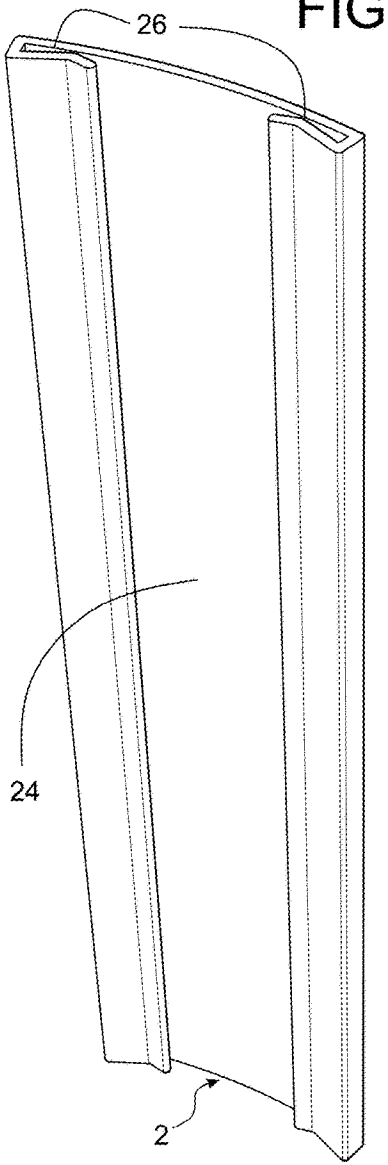
FIG. 3 is a front, top perspective view showing the channel insert according to an exemplary embodiment of the present disclosure.

Turning to FIGS. 3-5, according to exemplary embodiments, the channel insert 2 includes a curved profile such that the back 22 of the channel insert 2 has a convex profile while the front 24 of the channel insert 2 has a concave profile. FIGS. 8-23 show additional views of the channel insert 2 according to exemplary embodiments of the present disclosure.

Figure 7:
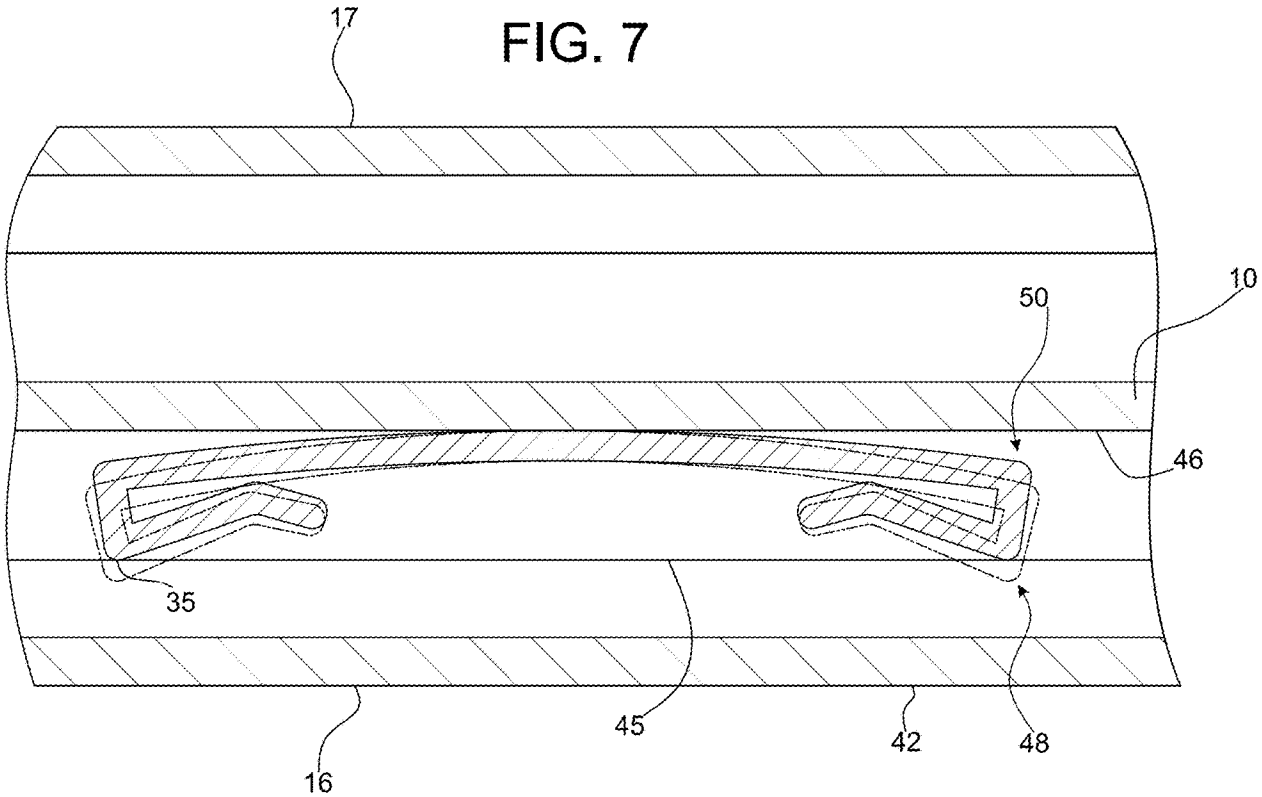
FIG. 7 is a cross-sectional view of the sign board with a channel insert of FIG. 1 taken along line 7-7.

In an exemplary embodiment, the channel insert 2 is formed to have elastic properties so that channel insert 2 is configured to return to its curved configuration after being distorted to a flatter profile. The elastic properties of the channel insert 2 are further illustrated in FIG. 7, which shows the normal curved profile shape 48 of the channel insert 2 in broken line (i.e. the natural state of the channel insert 2). The distorted, flattened profile shape 50 is shown in solid line and is the result of the channel insert 2 being inserted into the channel tracks 13, 14 of the panel 10 that have a smaller width than the channel insert 2 in its natural state 48. When inserted into the channel tracks 13, 14, the elastic properties of the channel insert 2 are configured to generate a biasing force that acts on the panel 10 and correspond channel tracks 13, 14. This biasing force secures the channel insert 2 within the panel 10 when the channel insert 2 is inserted into the channel tracks 13, 14. Because the channel insert 2 is self-securing with the bias force, additionally fastening means to secure the channel insert 2 within the panel 10 may be advantageously omitted.

In an exemplary embodiment, the convex back surface 22 of the channel insert 2 contacts and presses against the surface 46 of the panel 10 while the front corners 35 of the channel insert contact and press against the inner surface 45 of the inwardly directed portion 44 of the top channel track 14. That is, the biasing force results from the dimensions of the channel tracks 13, 14 of the sign board 8 with respect to the curvature of the curved channel insert 2. When inserted into the channel tracks 13, 14 of the panel 10, the curvature of the curved channel insert 2 causes the convex surface 22 of the curved channel insert 2 to engage the surface 46 of the panel 10 of the sign board 8 (i.e. surface extending between the channels) and causes the corners 35 (FIG. 5) of the return legs 26 of the curved channel insert 2 to engage the inner surface of the 45 of the inwardly directed portion 44 of the top channel track 14. This engagement of the back and front of the channel insert 2 with the panel 10 secures the channel insert 2 in place within the panel 10.

In an exemplary embodiment, the degree of curvature and/or the rigidity of the curved channel insert 2 may be selected (e.g. during manufacturing) to increase or decrease the amount of biasing force generated by the curved channel insert 2 when inserted in a corresponding sign board 8, and/or to accommodate sign boards 8 having different channel dimensions. For example, if additional holding force is desired, the degree of curvature and/or the rigidity can be increased to increase the biasing force generated by the channel insert 2 when inserted into the panel 10.

With reference to FIG. 5, in an exemplary embodiment, the curved channel insert 2 includes return legs 26 that are formed on the lateral ends of the curved surface of the curved channel insert 2. The return legs 26 are configured as clips that are configured to secure signage 4 inserted on the concave surface 24 of the channel insert 2. In this embodiment, the signage 4 may be accommodated between the adjacent return legs 26. The return legs 26 may be configured to provide a holding/biasing force to secure the signage 4 between the respective return leg 26 and the concave surface 24 so as to secure the signage within the channel insert 2. Because the return legs 26 are configured to securely hold the signage 4 within the channel insert 2, additionally fastening means (e.g. adhesive) to secure the signage 4 on the concave surface 24 may be advantageously omitted.

In an exemplary embodiment, the return legs 26 include a bent edge portion 28 that extends from the concave surface 24 (e.g. approximately perpendicularly from the surface 24). From the distal end of the bent edge portion 28, an inwardly angled portion 30 extends at an angle towards the concave surface 24. From the distal end of the inwardly angled portion 30, a tail portion 32 extends at an angle away from the concave surface 24. The angle of the tail portion 32 allows for an easier insertion of the signage 4 between the return leg 26 and the concave surface 24. A bias point 34 is formed at the junction of the inwardly angled portion 30 and the tail portion 32. The bias/contact point 34 contacts or is immediately adjacent to the concave surface 24. When signage is inserted into the return legs 26, the bias point 34 contacts the signage such that the signage is held between the concave surface 24 and the bias point 34. The distance between the bias point 34 and the concave surface 24 can be set (e.g. during manufacturing) based on the intended thickness of the signage 4.

In an exemplary embodiment, the concave 24 and/or convex 22 surface of the curved channel insert 2 may be configured to receive and accommodate signage 4, such as a sign or label (e.g. label "A123" or "B456") in FIG. 1. In embodiments where the signage 4 is placed on the convex surface 22, one or more fasteners may be used to secure the signage to the convex surface 22, such as an adhesive, hook-and-loop fastener, magnet, and/or other removable or permanent fastening means as would be understood by one of ordinary skill in the art. Additionally or alternatively, one or images and/or text may printed onto the concave 24 and/or convex 22 surfaces. Additionally or alternatively, images and/or text may be formed on the concave 24 and/or convex 22 surfaces (e.g. impressed into the surface).

Although the Figures illustrate the channel insert 2 with continuous return legs 26 running the full length of the channel insert 2, the disclosure is not limited thereto. In an exemplary embodiment, the return legs 26 may be discontinuous along the length of the channel insert 2. For example, the return legs 26 may be formed at the top and bottom ends of the channel insert 2 (e.g. the portion of the channel insert that engages the channel tracks 13, 14 of the sign board 8) while being omitting in the middle portion of the channel insert 2. In another embodiment, the return legs may be formed intermittently along the length of the channel insert at regular or irregular positions.

In one or more embodiments, the return legs 26 may be omitted completely. In an embodiment in which the return legs are omitted, the signage may be secured to the concave surface 24 with one or more fasteners, such as an adhesive, hook-and-loop fastener, magnet, and/or other removable or permanent fastening means as would be understood by one of ordinary skill in the art. One or more of these fasteners may also be used in embodiments that include complete or partial return legs 26 to further secure the signage to the channel insert 2.

The channel insert 2 may be made with different lengths (height as viewed in the drawings) and widths. For example, the length of the channel can be selected to correspond to the distance between the adjacent tracks channels of the panel 10 of the sign board 8. In an exemplary embodiment, the length of the channel insert 2 is 5.75 inches, but is not limited thereto. The width (when in its natural curved state) can be for example, about 1.3 inches, but is not limited thereto. The channel insert 2 may be made of one or more plastics (e.g. polystyrene, high-impact polystyrene, etc.), metals, composites, and/or other materials as would be understood by one of ordinary skill in the art. The channel insert 2 may be formed of by an extrusion process, but is not limited thereto.

To enable those skilled in the art to better understand the solution of the present disclosure, the technical solution in the embodiments of the present disclosure is described clearly and completely below in conjunction with the drawings in the embodiments of the present disclosure. Obviously, the embodiments described are only some, not all, of the embodiments of the present disclosure. All other embodiments obtained by those skilled in the art on the basis of the embodiments in the present disclosure without any creative effort should fall within the scope of protection of the present disclosure.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

The invention claimed is:

1. A channel insert, comprising:

a concave surface;

a convex surface opposite the concave surface; and a return leg that extends from a lateral edge of the channel insert and is disposed over a portion of the concave surface, wherein, in response to the channel insert being inserted into a panel of a sign board:

the concave surface or the return leg is configured to engage an inner surface of a channel track of the panel, and the convex surface is configured to engage a surface of the panel.

2. The channel insert of claim 1, wherein the concave and/or convex surface of the channel insert is configured to receive a label or signage.

3. The channel insert of claim 1, wherein the return leg is configured to secure a label or signage on the concave surface of the channel insert.

4. The channel insert of claim 1, wherein the channel insert is configured to generate a biasing force against the inner surface of the channel track of the panel and the surface of the panel to secure the channel insert in the panel.

5. The channel insert of claim 1, wherein the channel insert is configured to elastically deform in response to being inserted into the panel of the sign board, the elastic deformation generating a biasing force against the inner surface of the channel track of the panel and the surface of the panel to secure the channel insert in the panel.

6. The channel insert of claim 5, wherein the channel insert is configured to return from the elastic deformation to a natural state in response to being removed from the panel of the sign board.

7. The channel insert of claim 6, wherein the channel insert has a higher degree of curvature in the natural state than when elastically deformed.

8. The channel insert of claim 5, wherein a degree of curvature of the channel insert decreases in response to being elastically deformed.

9. The channel insert of claim 1, wherein the channel insert is configured to secure itself within the panel based on the engagement with the inner surface of the channel track of the panel and the engagement with the surface of the panel.

10. The channel insert of claim 1, wherein the panel includes another channel track, the surface of the panel extending between the channel track and the other channel track.

11. The channel insert of claim 10, wherein the channel insert is configured to engage both the channel track and the other channel track.

12. The channel insert of claim 1, wherein the return leg is continuous along a length of the channel insert.

13. The channel insert of claim 1, further comprising a second return leg that extends from a second lateral edge of the channel insert opposite the lateral edge and is disposed over a second portion of the concave surface opposite the portion of the concave surface.

14. The channel insert of claim 13, wherein the return leg and the second return leg are each configured to engage the inner surface of the channel track of the panel.

15. A sign system, comprising:

a sign board including a panel that includes at least one channel track; and a channel insert configured to be insertable into the at least one channel track and to secure itself within the at least one channel track, wherein the channel insert includes:

a concave surface;

a convex surface opposite the concave surface; and a return leg that extends from a lateral edge of the channel insert and is disposed over a portion of the concave surface, wherein, in response to the channel insert being inserted into the panel:

the concave surface or the return leg is configured to engage an inner surface of the at least one channel track, and the convex surface is configured to engage a surface of the panel.

16. The system of claim 15, wherein the concave and/or convex surface of the channel insert is configured to receive a label or signage.

17. The system of claim 15, wherein the channel insert further comprises a second return leg that extends from a second lateral edge of the channel insert opposite the lateral edge, the second return leg being disposed over a second portion of the concave surface.

18. The system of claim 15, wherein the return leg is configured to engage the inner surface of the at least one channel track.

19. The system of claim 15, wherein the channel insert is configured to elastically deform in response to being inserted into the panel, the elastic deformation generating a biasing force against the inner surface of the at least one channel track and the surface of the panel to secure the channel insert in the panel.

20. The system of claim 19, wherein the channel insert is configured to return from the elastic deformation to a natural state in response to being removed from the panel.

21. A channel insert, comprising:

a concave surface; and a convex surface opposite the concave surface, wherein, in response to the channel insert being inserted into a panel of a sign board:

the concave surface is configured to engage an inner surface of a channel track of the panel or a surface of the panel;

the convex surface is configured to engage the other of the inner surface of the channel track and the surface of the panel; and the channel insert is configured to elastically deform, the elastic deformation generating a biasing force against the inner surface of the channel track of the panel and the surface of the panel to secure the channel insert in the panel, wherein a degree of curvature of the channel insert decreases in response to being elastically deformed.

* * * * *